US008137156B1

(12) United States Patent
Gasman

(10) Patent No.: US 8,137,156 B1
(45) Date of Patent: Mar. 20, 2012

(54) ENCLOSURE APPARATUS AND METHOD

(76) Inventor: Daniel T. Gasman, Raleigh, NC (US)

( * ) Notice: Subject to any disclaimer, the term of this patent is extended or adjusted under 35 U.S.C. 154(b) by 476 days.

(21) Appl. No.: 12/344,869

(22) Filed: Dec. 29, 2008

(51) Int. Cl.
*B24B 55/10* (2006.01)

(52) U.S. Cl. ..... 451/28; 451/453

(58) Field of Classification Search ..... 451/451, 451/452, 453, 454, 455, 456, 90, 87, 28
See application file for complete search history.

(56) References Cited

U.S. PATENT DOCUMENTS

| | | | | |
|---|---|---|---|---|
| 2,520,627 | A * | 8/1950 | Dick | 451/453 |
| 2,991,001 | A * | 7/1961 | Hughes | 383/210.1 |
| 4,214,317 | A * | 7/1980 | Kelly, Sr. | 2/11 |
| 4,281,485 | A * | 8/1981 | Charity, III | 451/29 |
| 4,612,916 | A * | 9/1986 | Akers et al. | 600/21 |
| 4,626,291 | A | 12/1986 | Natale | 134/21 |
| 4,633,899 | A | 1/1987 | Lord | 137/357 |
| 4,765,352 | A | 8/1988 | Strieter | 134/99 |
| 5,017,197 | A | 5/1991 | McGuire et al. | 55/1 |
| 5,062,871 | A | 11/1991 | Lemon, III | 55/259 |
| 5,088,511 | A | 2/1992 | Bain | 134/200 |
| 5,131,934 | A | 7/1992 | Patel | 55/385.1 |
| 5,295,771 | A | 3/1994 | Wehrmann et al. | 408/67 |
| 5,464,286 | A | 11/1995 | Stevens et al. | 383/75 |
| 5,520,449 | A | 5/1996 | Klak | 312/1 |
| 5,759,333 | A | 6/1998 | Ross | 156/308.4 |
| 5,785,396 | A | 7/1998 | Israel | 312/1 |
| 5,915,839 | A | 6/1999 | Dennis | 383/11 |
| 6,099,395 | A * | 8/2000 | Guseman | 451/75 |
| 6,364,748 | B1 * | 4/2002 | Zwicker et al. | 451/38 |
| 6,875,083 | B2 * | 4/2005 | Gunnell | 451/38 |
| 6,973,997 | B2 | 12/2005 | Fara | 182/141 |
| 6,997,653 | B2 | 2/2006 | Styles | 408/67 |
| 7,104,877 | B1 | 9/2006 | Terry | 451/354 |

* cited by examiner

*Primary Examiner* — Robert Rose

(57) ABSTRACT

An enclosure apparatus for containing dust and debris such as may be generated while repairing a drywall surface. The enclosure apparatus includes a flexible, transparent body and may include a sealable slit, glove and pouch. The method of use allows the enclosure apparatus to be securely affixed to the drywall surface with a pressure sensitive adhesive. Tools or otherwise can be placed within the enclosure body prior to attachment to the drywall surface. Once the dust generating work is completed the enclosure apparatus can be removed, cleaned and properly disposed.

3 Claims, 4 Drawing Sheets

ENCLOSURE APPARATUS AND METHOD

FIELD OF THE INVENTION

The present invention relates to an improved method and apparatus for the creation of an isolated work environment. More particularly the invention relates to a flexible enclosure apparatus incorporating a pressure sensitive adhesive for adhering and sealing the apparatus to a work surface to contain dust and debris.

DESCRIPTION OF THE PRIOR ART AND OBJECTIVES OF THE INVENTION

Dust and debris are often generated during the repair, maintenance, rehabilitation, or renovation of various structures. This dust and debris frequently constitutes a nuisance, for example when dust is generated form drywall, lead paint or asbestos containing materials. There is a great need for work enclosures that are able to contain such dust and debris to prevent harm and injury.

The use of glove bags is known in the prior art for the containment of dust and debris. Examples include U.S. Pat. No. 5,131,934 (Patel), U.S. Pat. No. 5,017,197 (McGuire), U.S. Pat. No. 5,520,449 (Klak), U.S. Pat. No. 4,626,291 (Natale), U.S. Pat. No. 5,088,511 (Bain), U.S. Pat. No. 5,062,871 (Lemon), U.S. Pat. No. 5,785,396 (Israel), and U.S. Pat. No. 5,759,333 (Ross).

Approaches other than glove bags have been taken to create work enclosures for the containment of dust and debris. U.S. Pat. No. 6,973,997 B2 (Fara) discloses pollution containment apparatus for making a penetration in a ceiling or wall of a building or other structure. U.S. Pat. No. 4,765,352 (Strieter) discloses a portable isolation enclosure for use in cleaning contaminated environments. U.S. Pat. No. 5,295,771 (Wehrmann et al.) discloses a clean room tool chamber. U.S. Pat. No. 7,104,877 B1 (Terry) discloses a dust containment apparatus for drywall sanding. U.S. Pat. No. 5,464,286 (Stevens et al.) discloses a ceiling tile dust and debris catcher.

Other prior art of which the applicant is aware is as follows: U.S. Pat. No. 4,633,899 (Lord) describes a device for providing a temporary remedy for ceiling leaks, U.S. Pat. No. 6,997,653 B2 (Styles) describes a debris collection device and method, and U.S. Pat. No. 5,915,839 (Dennis) describes a dust bag.

While these devices fulfill their particular objectives and requirements, the aforementioned devices do not utilize pressure sensitive adhesives capable of forming a seal with a work surface to thereby create an isolated work space for containing dust and debris generated therein.

In this respect the present invention substantially departs from the conventional concepts and designs of the prior art, and one of its main objectives is to provide a flexible enclosure apparatus that forms an adhesive seal with a work surface to thereby aid the user in the containment of dust and debris.

It is another objective of the present invention to provide apparatus in the form of a flexible, transparent polymeric enclosure or bag which includes a pressure sensitive adhesive at the open end for attachment to a work surface such as a wall, floor or ceiling.

It is yet another objective of the present invention to provide an enclosure apparatus which includes a rigid or semi-rigid frame for placement over the work area and for attachment of the flexible enclosure.

It is another objective of the present invention to provide a flexible enclosure apparatus body which includes an integrally formed tool pouch and glove.

It is also an objective of the present invention to provide an inexpensive, easy to use isolation enclosure apparatus having a flexible enclosure body having a re-sealable opening or slit.

It is still another objective of the present invention to provide a method for enclosing and isolating a work area for containing dust and debris.

Various other objectives and advantages of the present invention will become apparent to those skilled in the art as a more detailed description is set forth below.

SUMMARY OF THE INVENTION

To alleviate the disadvantages and deficiencies of prior art devices and methods, the present invention provides a flexible enclosure apparatus which utilizes a pressure sensitive adhesive on its open end to adhere the enclosure apparatus to a selected work surface such as a building wall, vehicle body surface or the like and to form a secure seal between the enclosure apparatus and the selected surface which may be for example a building wall or ceiling. The pressure sensitive adhesive is an integral part of the enclosure apparatus and allows for secure adhesion to a work surface, yet is removable without damaging the work surface or leaving behind a residue. Furthermore, the pressure sensitive adhesive forms a seal with the work surface to help contain dust and debris generated within the enclosed work surface during operation and use.

In one embodiment of the invention, the bond between the pressure sensitive adhesive and the work surface serves to support the work environment, its contents (for example, sanding blocks or other small tools), and any dust or debris collected in the enclosure apparatus body.

In an embodiment of the invention, the open end of the enclosure apparatus body is flexible, allowing the opening to be adjusted to conform to the desired shape of the selected work surface. In another embodiment the open end is made rigid by the use of a frame, facilitating secure adhesion to relatively flat surfaces such as walls. The frame can help to maintain the enclosure apparatus body in an open position when mounted on a vertical surface such as a wall.

In a preferred embodiment of the invention, the enclosure apparatus body is constructed, at least in part, from a transparent polymeric material allowing the enclosed work surface to be easily observed.

A sealable slit is incorporated into the flexible enclosure apparatus body. This sealable slit allows easy access to the interior of the sealed enclosure body so that objects or materials can be added or removed as needed, or to allow access for items such as power cords, hoses, or tubing. The sealable slit also allows the interior of the enclosure to be viewed, for example if the visibility is obscured by a film of dust or debris on the interior of the enclosure apparatus body. As will be appreciated by one skilled in the art, the sealable slit can take a variety of forms. One particularly useful form for this slit is in the form of a standard zip-loc type closure having a slide although other closures such as those employing hook and loop fasteners could also be employed.

In some embodiments the body of the enclosure apparatus contains a closure device to contain the contents once the enclosure apparatus has been removed from the work surface. The nature of the closure device can take a variety of forms. Examples of suitable closure devices include conventional drawstrings, zip-loc type closures, ties, and adhesive strips.

In one embodiment of the invention, the body of the enclosure apparatus defines one or more gloves to facilitate the manipulation of objects or materials within the sealed enclosure apparatus body from the outside and a pouch to hold small tools.

DETAILED DESCRIPTION OF THE PREFERRED EMBODIMENT AND OPERATION OF THE INVENTION

For a better understanding of the invention and its operation, turning now to the drawings, and in particular FIGS. 1-4, enclosure apparatus embodying the principles and concepts of the present invention will be described.

Figure 1:
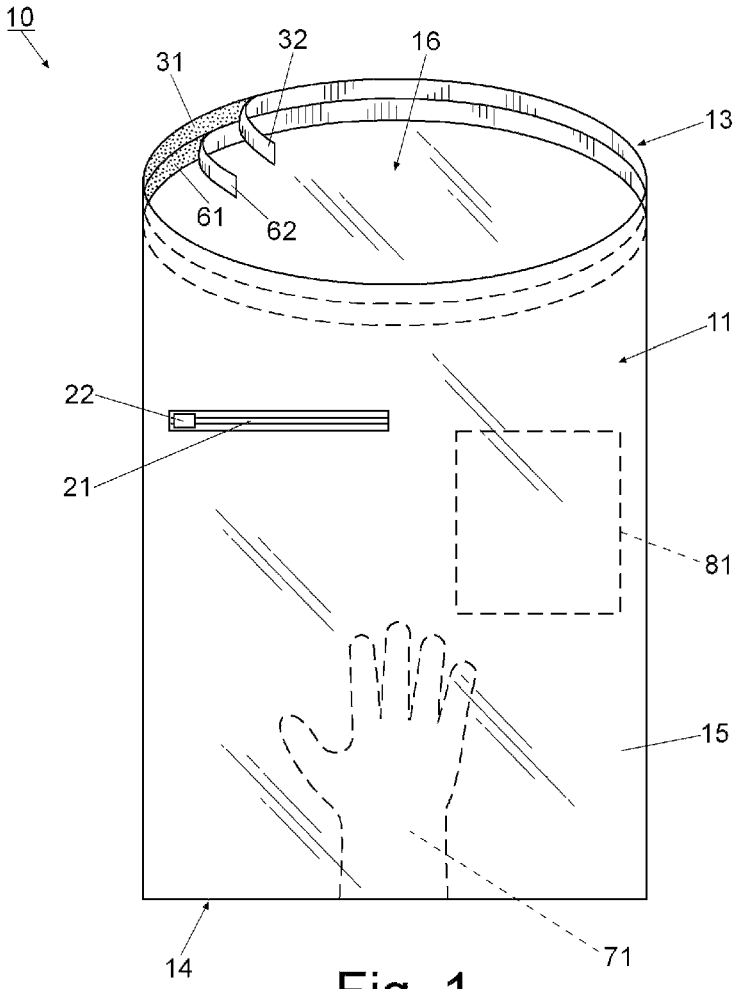
FIG. 1 shows the flexible enclosure apparatus of the invention with a pressure sensitive adhesive on the inside of the opening.

FIG. 1 shows a first embodiment of the invention with body of enclosure apparatus 10 which consists of a flexible polymeric bag like structure. Body 11 is formed from a clear, transparent plastic such as a standard thin polyethylene material. Body 11 includes top 13, closed bottom 14 and side walls, generally at 15. At top opening 16 of body 11 pressure sensitive adhesive 31 is placed around the entire inside circumference of opening 16. Standard pressure sensitive adhesive 31 is used to adhere body 11 to a selected work surface and form a seal therebetween. Preferably pressure sensitive adhesive 31 is selected so that it provides adequate adhesion to the work surface, but is removable without damaging the work surface or leaving behind a residue. A typical release strip 32 is provided to preserve pressure sensitive adhesive 31 prior to use.

Enclosure body 11 includes a manual sealable slit 21 with closure slide 22 to allow easy access to the interior of body 11 once enclosure apparatus 10 has been adhered to a work surface (FIG. 4) thus eliminating the need to break the adhesive/work surface bond to access the interior of body 11. Objects or materials utilized can be added or removed from body 11 through slit 21 as needed. Further, slit 21 allows access for items such as power cords, hoses, or tubing. As needed, slit 21 can be utilized to view the interior of the enclosure, for example if the visibility is obscured by a film of dust or debris on the interior of body 11.

Body 11 also optionally includes a second standard pressure sensitive adhesive 61 (which may be the same as adhesive 31) and a second release strip 62 inside opening 16. Second adhesive 61 is proximate first adhesive 31 and can be used to contain the dust and debris in body 11 when enclosure apparatus 10 is removed from the work surface. Body 11 also optionally contains glove 71 to facilitate manipulation of objects or materials within body 11 and contains pouch 81 for holding items such as small tools or materials therein. Glove 71 and pouch 81 are preferably formed with body 11 during manufacturing. Glove 71 is open to the outside surface of body 11 for hand insertion while body 11 is attached to a work surface.

Figure 2:
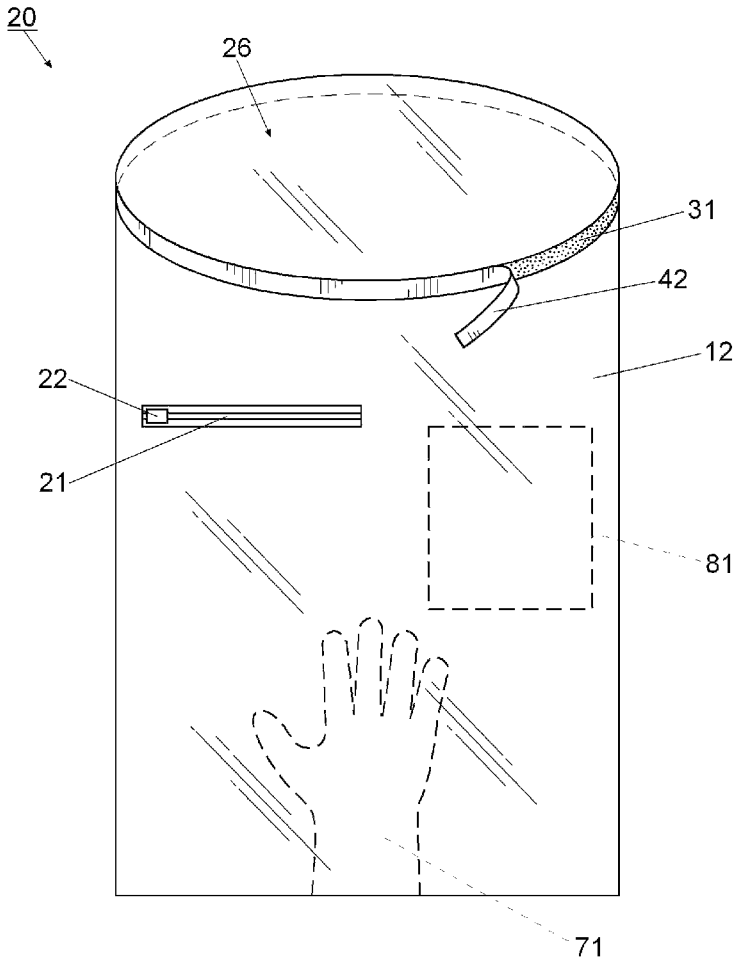
FIG. 2 depicts another embodiment of the enclosure apparatus with a pressure sensitive adhesive on the outside of the flexible opening.

In FIG. 2 body 12 of a second embodiment, namely enclosure apparatus 20 is seen also consisting of a flexible bag like structure. Round top opening 26 of body 12 contains pressure sensitive adhesive 31 placed around the entire outer circumference of side walls 15, unlike the inner placement of adhesive 31 seen in FIG. 1. Pressure sensitive adhesive 31 is also used to adhere body 11 to a work surface (not seen in FIG. 2) and form a seal therebetween. Pressure sensitive adhesive 31 is selected so as to provide adequate adhesion between body 12 and the work surface, but is removable without damaging the work surface or leaving behind residue. Release strip 42 is provided to cover or shield pressure sensitive adhesive 31 prior to use. Body 12 also provides a manually sealable slit 21 with slide 22 to allow access as desired to the interior of body 12 once adhered to a work surface. Body 12 also optionally contains glove 71 to facilitate manipulation of objects or materials therewithin and pouch 81 for desired holding items inside of body 12.

Figure 3:
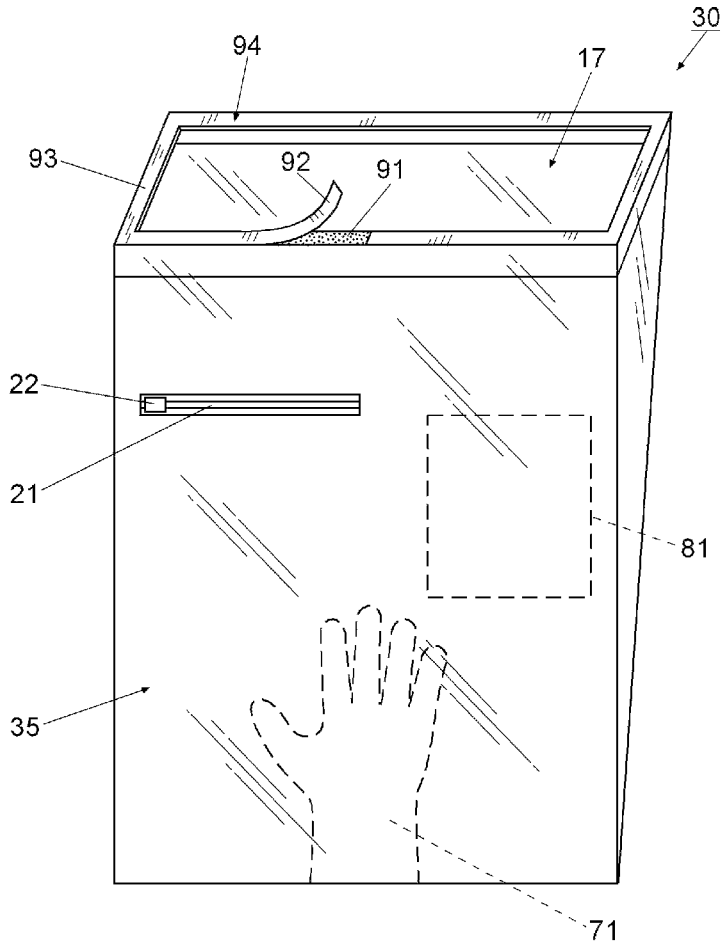
FIG. 3 demonstrates the preferred flexible enclosure apparatus with a rigid frame in the opening and pressure sensitive adhesive on the outside face of the frame.

In FIG. 3 the preferred form of the enclosure apparatus is seen with body 35 of enclosure apparatus 30 consisting also of a transparent flexible polymeric material. At rectangular top opening 17 of body 35 is a rigid rectangular structure or frame (also seen in FIG. 4) made preferably from plastic, though metals or other materials may be used to force opening 17 to remain open. Pressure sensitive adhesive 91 with release paper 92 is placed around the entire rectangular outward face 94 of rigid frame 93 and is used to adhere frame 93 to a work surface such as work surface 51 of wall 50 seen in FIG. 4. Pressure sensitive adhesive 91 is selected to provide adequate adhesion to the work surface, but is removable without damaging the work surface or leaving behind a residue. Release strip 92 is provided to preserve pressure sensitive adhesive 91 prior to use. Body 35 of enclosure apparatus 30 also includes pressure sensitive adhesive 31 with release strip (not shown) positioned proximate opening 17 around the entire interior circumference of body 35. Adhesive 31 is used to adhere body 35 to frame 93. Body 35 also provides sealable slit 21 to allow access to the interior of body 35 as hereinbefore described. Body 35 optionally contains interior glove 71 and pouch 81 as described regarding FIGS. 1 and 2.

While frame 93 is shown having a rectangular shape various other shapes could be employed such as round, oval or otherwise. Body 35 is flexible whereby opening 17 can take on various shapes as necessary and can be placed over rectangular or other shaped frames. As would be understood body 35 could also be formed having other shaped openings as desired.

Figure 4:
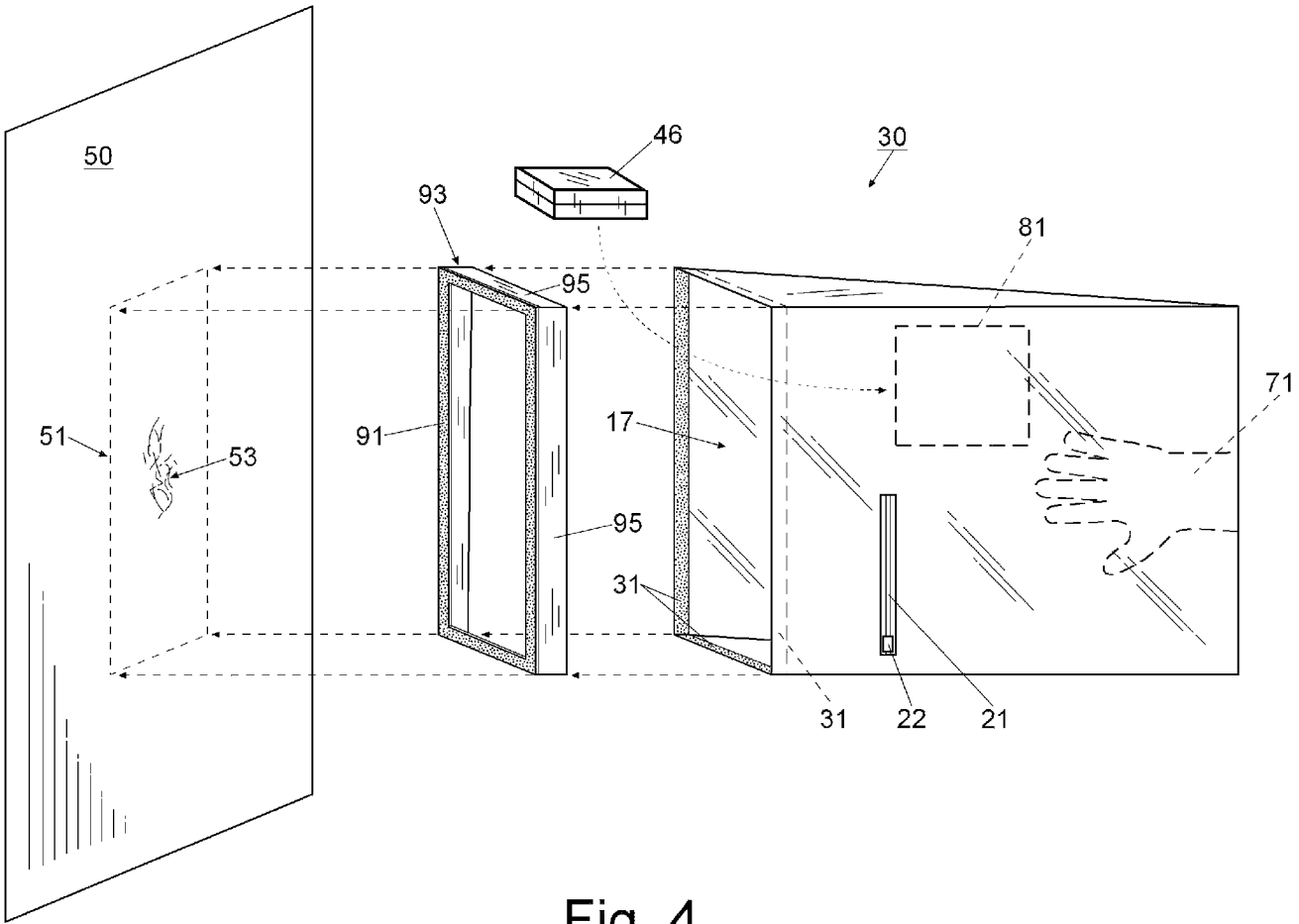
FIG. 4 features an exploded view of the preferred enclosure apparatus as seen in FIG. 3 with the rigid frame and enclosure body exploded from a wall to be repaired.

A schematic exploded representation of the invention is seen in FIG. 4 with enclosure apparatus 30 for attaching to wall 50. In opening 17 of body 35 rigid frame 93 is inserted which insures top opening 17 remains open. Adhesive 31 along the inner perimeter of top opening 17 attaches body 35 to the outside surrounding flanges 95 of rectangular frame 93. Sanding block 46 is but one of many small tools that could be placed in interior pouch 81 of body 35 prior to attachment to a work surface.

With respect to the above description it is to be realized that the optimum dimensional relationship for the parts of the invention will include variations in size, materials, shape, and form, function, and manner of operation, assembly and use. All equivalent relationships to those illustrated in the drawings and described in the specification are intended to be encompassed in the present invention.

In the method of using enclosure apparatus 10 as seen in FIG. 1, a work site or surface such as work site 51 on wall 50 (FIG. 4) is selected. As would be understood wall 50 is one example of a typical sheet rock wall in a building with a defective surface area, generally at 53. Sanding or other work at area 53 may create a dust or debris hazard requiring containment. In using enclosure apparatus 10, release strip 32 is pulled from adhesive 31 as seen in FIG. 1 exposing adhesive 31. Next body 11 is attached to work surface 51 on wall 50 by pressing adhesive 31 thereagainst to seal body 11 to wall 50 around area 53. Glove 71 can then be used to manipulate sanding block 46 (FIG. 4) or other tools within body 11 which will contain any dust or debris generated. When the dust generating repair work is finished, body 11 is urged from work surface 51. Second release strip 62 is removed from second adhesive 61 and top opening 16 of body 11 is then closed to allow adhesive 61 to seal body 11 for containing all dust and debris therein. Work surface 51 can then be painted or otherwise further repaired and enclosure apparatus 10 properly disposed.

When using the second embodiment of the invention, namely enclosure apparatus 20 as seen in FIG. 2 for dust containment, the method of use is similar to that described for the first embodiment seen in FIG. 1 except body 12 is sealed to wall 50 (FIG. 4) by folding adhesive 31 inwardly against work surface 51 so adhesive 31 positioned against the outer perimeter of body 12 then contacts work surface 51 to form a tight seal therebetween. After the dust and debris generation of the work is completed, body 12 of enclosure apparatus 20 is urged from wall 50 and closed with a standard bag tie, tape or the like before disposal. After removal of body 12 repair of wall 50 can be completed such as by painting if needed.

In the preferred method of use, enclosure apparatus 30 as shown in FIGS. 3 and 4 is selected. Frame 93 as seen in FIG. 3 is rectangular in shape with face 94 supporting pressure sensitive adhesive 91 and release strip 92 thereon and includes flanges 95. Body 35 as seen in FIG. 3 is manually attached to frame 93 by urging opening 17 of body 35 over flanges 95 and then removing the release strip (not seen in FIG. 4) to expose adhesive 31. Adhesive 31 is then pressed against flanges 95 to tightly seal body 35 and frame 93 together. Next, enclosure apparatus 30 is affixed to a desired work surface such as a wall, ceiling or the like as seen in FIG. 4 with wall 50. Release strip 92 (FIG. 3) is removed from frame face 94 to expose adhesive 91 and frame face 94 is then urged into tight contact with work surface 51. After use, enclosure apparatus 30 is removed from wall 50, body 35 is removed from frame 93. Body 35 can then be closed with ties, tape or otherwise to prevent escape of contained dust and debris therein. Body 13 is then properly disposed. Frame 93 can be cleaned as necessary and another adhesive 91 and release strip 92 applied as necessary for reuse.

Having described preferred embodiments of a new and improved work enclosure for containing dust and debris with the present invention, it is believed that other modifications variations and changes will be suggested to those skilled in the art in view of the teachings set forth herein. It is therefore to be understood that all such variations, modifications and changes are believed to fall within the scope of the present invention as defined by the appended claims.

I claim:

1. A method of isolating a selected work surface for collecting dust and debris therefrom comprising the steps of:

a) providing an enclosure apparatus having a flexible body with an open top, and first and second adhesives positioned around the open top, each of said first and second adhesives covered with a different release strip;

b) removing one of said release strips to expose said first adhesive;

c) adhering the enclosure apparatus to the work surface using said first adhesive;

d) generating dust from the work surface inside the enclosure apparatus;

e) removing the enclosure apparatus from the work surface;

f) removing the other release strip from the enclosure apparatus to expose the second adhesive; and g) sealing the dust inside the enclosure apparatus by engaging the second adhesive with itself to close the top.

2. The method of claim 1 wherein adhering the enclosure apparatus to the work surface comprises the step of adhering a frame to the flexible body and thereafter attaching the frame to the work surface using one of said pair of adhesives.

3. The method of claim 2 wherein adhering the frame to the work surface comprises the step of adhesively attaching the frame to the work surface after removing one of said release strips.

* * * * *